US007621725B2

(12) United States Patent
Huang et al.

(10) Patent No.: US 7,621,725 B2
(45) Date of Patent: Nov. 24, 2009

(54) SWING TYPE FAN

(75) Inventors: Ting-Chiang Huang, Taipei (TW); Shaw-Fuu Wang, Taipei (TW); Shih-Chen Shen, Taipei (TW); Sheng-Jie Syu, Taipei (TW)

(73) Assignee: Inventec Corporation, Taipei (TW)

( * ) Notice: Subject to any disclaimer, the term of this patent is extended or adjusted under 35 U.S.C. 154(b) by 51 days.

(21) Appl. No.: 12/016,419

(22) Filed: Jan. 18, 2008

(65) Prior Publication Data

US 2009/0047152 A1 Feb. 19, 2009

(30) Foreign Application Priority Data

Aug. 15, 2007 (TW) ..... 96130155 A

(51) Int. Cl.
*F04B 19/00* (2006.01)

(52) U.S. Cl. ..... 417/420; 417/436; 416/146 R

(58) Field of Classification Search ..... 417/420, 417/410.1, 410.2, 436; 416/146 R, 79, 142
See application file for complete search history.

(56) References Cited

U.S. PATENT DOCUMENTS 1,328,255 A * 1/1920 Anderson ..... 416/79
4,063,826 A * 12/1977 Riepe ..... 417/410.1
5,104,626 A * 4/1992 Yang ..... 422/124
6,043,978 A * 3/2000 Mody et al. ..... 361/690

* cited by examiner

*Primary Examiner*—Devon C Kramer
*Assistant Examiner*—Todd D Jacobs
(74) *Attorney, Agent, or Firm*—J.C. Patents

(57) ABSTRACT

A swing type fan including a frame, a motor, at least one blade, at least one first magnetic element and at least one second magnetic element is provided. The motor is fixed to the frame and has a shaft passing through the frame. The blade is disposed between the shaft and the frame and has a first side and a second side opposite to the first side. The first side of the blade is connected to the frame. The first magnetic element is disposed on the blade and is located between the first side and the second side of the blade. The second magnetic element is connected to the shaft and is corresponding to the first magnetic element. The second side of the blade swings via a magnetic force between the first magnetic element and the second magnetic element as the shaft drives the second magnetic element to rotate.

6 Claims, 3 Drawing Sheets

SWING TYPE FAN

CROSS-REFERENCE TO RELATED APPLICATION

This application claims the priority benefit of Taiwan application serial no. 96130155, filed on Aug. 15, 2007. The entirety of the above-mentioned patent application is hereby incorporated by reference herein and made a part of this specification.

BACKGROUND OF THE INVENTION

1. Field of the Invention

The present invention relates to a fan. More particularly, the present invention relates to a swing type fan.

2. Description of Related Art

With development of science and technology, portable electronic devices, such as notebook personal computer (PC), are widely used. It is different from the common electronic device that in order to seek for the convenience in carrying, the appearance design of the portable electronic device is usually designed to be light, thin, short, and small. However, due to the heat dissipating problem of the portable electronic device, the volume thereof might not be further reduced.

In the conventional art, the notebook PC usually uses a fan or a blower to provide relatively large cooling airflow to dissipate heat energy generated by internal electronic parts out of a case. However, for ultra mobile personal computer (UMPC) with a volume and a heat dissipating amount smaller than that of the notebook PC, the internal electronic parts do not require a great amount of cooling airflow to achieve heat exchange dissipation, so long as the air is prevented from not flowing to result in internal heat stock to cause an excessively high surface temperature of the case.

It should be noted that if the fan or the blower with relatively large volume is used to provide the cooling airflow, not only volume of the UMPC is increased, but also noise generated during rotation, power consumption amount, and flow field uniformity of the provided cooling airflow cannot achieve the requirements of the UMPC. Therefore, it is necessary to research and develop a fan that is lighter and thinner and more power saving, has smaller noise, and can provide cooling airflow with preferred flow field uniformity, and this is the key point of the present invention.

SUMMARY OF THE INVENTION

Accordingly, the present invention is directed to provide a swing type fan, with thinner total thickness, lower power consumption amount, and smaller noise generated during operation.

The present invention is directed to provide a swing type fan, which is capable of providing airflow with preferred flow field uniformity.

The present invention provides a swing type fan, which includes a frame, a motor, at least one blade, at least one first magnetic element, and at least one second magnetic element. The motor is fixed to the frame and has a shaft passing through the frame. The blade is disposed between the shaft and the frame and has a first side and a second side opposite to the first side. The first side of the blade is connected to the frame. The first magnetic element is disposed on the blade and is located between the first side and the second side of the blade. The second magnetic element is connected to the shaft and is corresponding to the first magnetic element. The second side of the blade swings via a magnetic force between the first magnetic element and the second magnetic element as the shaft drives the second magnetic element to rotate.

In an embodiment of the present invention, the first side of the blade is fixed to the frame, and the blade swings by elastic deformation.

In an embodiment of the present invention, the first side of the blade is fixed to the frame by adhering, welding, or locking.

In an embodiment of the present invention, the material of the blade includes soft rubber.

In an embodiment of the present invention, the first side of the blade is pivoted to the frame, and the blade swing via the magnetic forces.

In an embodiment of the present invention, one of the first magnetic element and the second magnetic element is a permanent magnet, and the other of the first magnetic element and the second magnetic element is the permanent magnet or a ferromagnetic material.

In an embodiment of the present invention, the fan further includes a third magnetic element connected to the shaft and disposed opposite to the second magnetic element. The second magnetic element and the first magnetic element are mutually attracted, and the third magnetic element and the first magnetic element are mutually repulsed.

The present invention further provides a swing type fan, which includes a frame, a motor, a plurality of blades, a plurality of first magnetic elements, a plurality of second magnetic elements, and a plurality of third magnetic elements. The motor is fixed to the frame and has a shaft passing through the frame. The blades are disposed between the shaft and the frame, and respectively have a first side and a second side opposite to the first side. The first sides are connected to two opposite sides of the frame in an offset manner. The first magnetic elements are disposed on the blades, and are respectively located between the first side and the second side of the corresponding blade. The second magnetic elements are connected to the shaft, and are corresponding to the first magnetic elements. The third magnetic elements are connected to the shaft and disposed opposite to the second magnetic elements. The second magnetic elements and the first magnetic elements are mutually attracted, and the third magnetic elements and the first magnetic elements are mutually repulsed. The second sides of the blades swing via magnetic forces between the first magnetic elements and the second magnetic elements and between the first magnetic elements and the third magnetic elements as the shaft drives the second magnetic elements and the third magnetic elements to rotate.

In an embodiment of the present invention, the first sides of the blades are fixed to the frame, and the blades swing by elastic deformation.

In an embodiment of the present invention, the first sides of the blades are fixed to the frame by adhering, welding, or locking.

In an embodiment of the present invention, the material of the blades includes soft rubber.

In an embodiment of the present invention, the first sides of the blades are pivoted to the frame, and the blades swing via the magnetic forces.

In an embodiment of the present invention, the first magnetic elements, the second magnetic elements, and the third magnetic elements are permanent magnets.

As compared to the fan and the blower in the conventional art, it is not necessary for the swing type fan of the present invention to use the shaft to drive the blades. The blades swing via magnetic forces, such that the power consumption amount of the motor during the operation is relatively low, without any wind noise or vibration noise of the conventional fan during high-speed rotation.

In order to make the aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The First Embodiment

Figure 1:
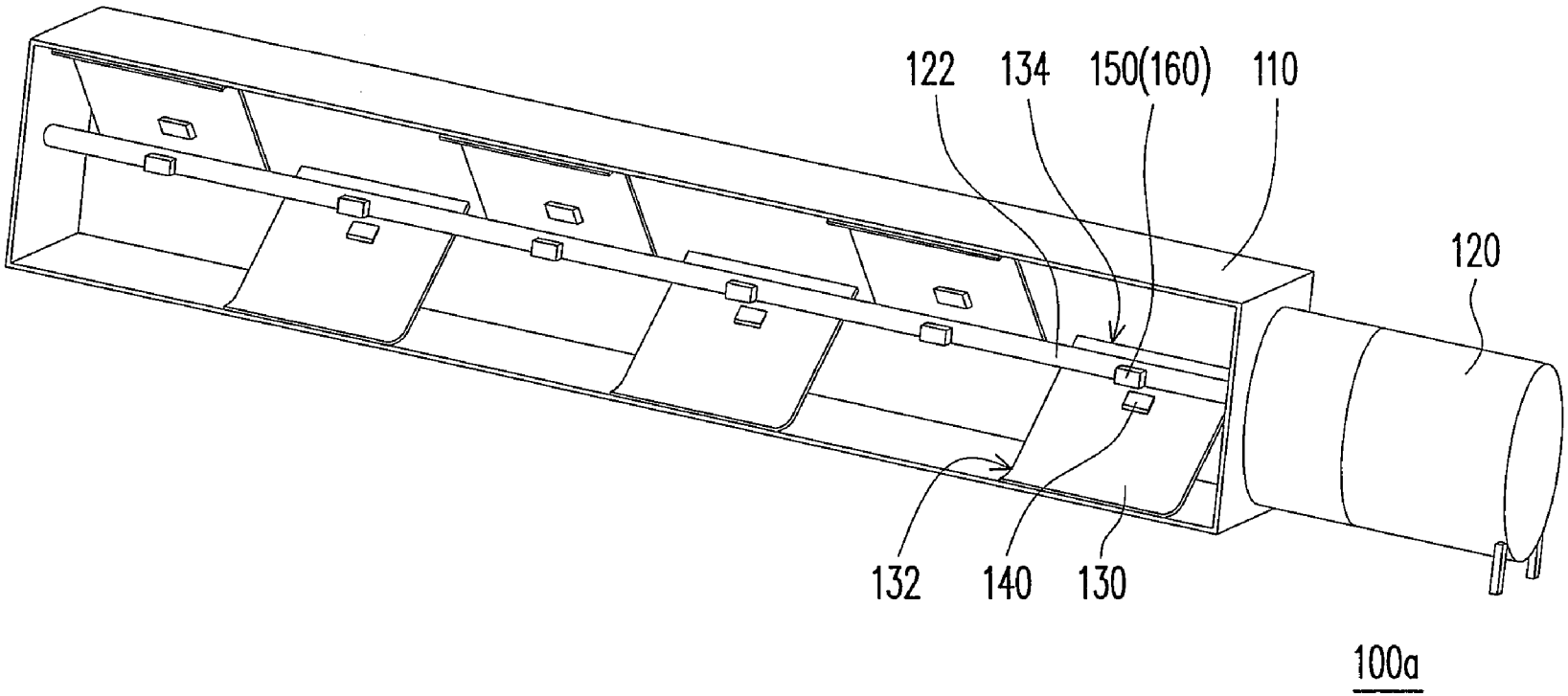
FIG. 1 is a schematic structural view of a swing type fan according to a first embodiment of the present invention.
Figure 2A:
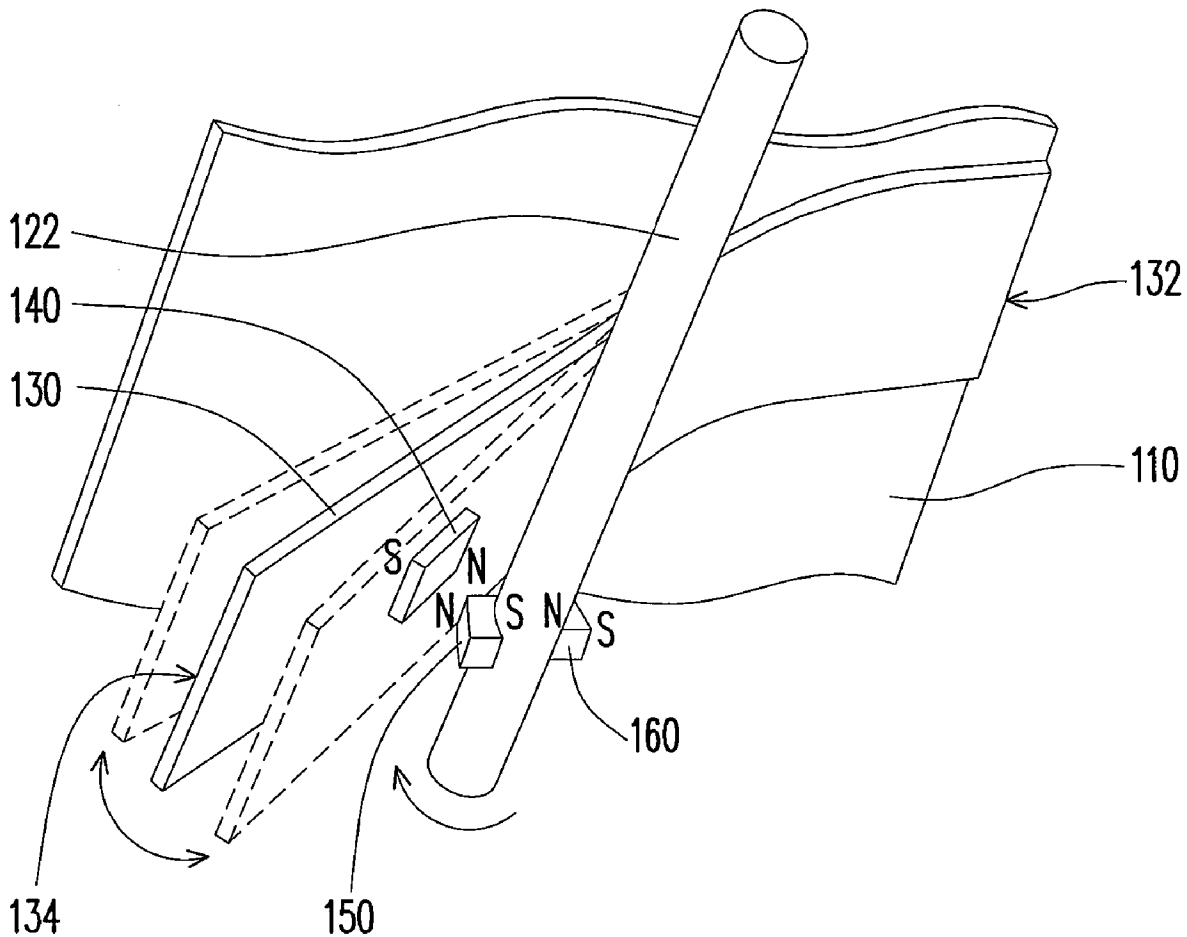
FIG. 2A is a schematic view of a partial enlarged structure and actuation of the fan of FIG. 1.

FIG. 1 is a schematic structural view of a swing type fan according to the first embodiment of the present invention, and FIG. 2A is a schematic view of a partial enlarged structure and actuation of the fan of FIG. 1. Referring to FIG. 1, a swing type fan 100*a* includes a frame 110, a motor 120, and a plurality of blades 130. The motor 120 is fixed to a side of the frame 110 and has a shaft 122 passing through the frame 110. The blades 130 are disposed between the shaft 122 and the frame 110, and a side of the blades 130 is connected to the frame 110 instead of pivoting on the shaft 122. Therefore, the blades 130 are not rotated through the shaft 122, but swing via a magnetic force between each first magnetic element 140 and the opposite second magnetic element 150, for providing the swinging airflow.

As shown in FIG. 1, the first magnetic elements 140 are disposed on the blades 130, and are located between the first sides 132 and the second sides 134 of the blades 130. In addition, the second magnetic elements 150 are connected to the shaft 122 and are corresponding to the first magnetic elements 140. The second sides 134 of the blades 130 swing via the magnetic force between the first magnetic elements 140 and the second magnetic elements 150 as the shaft 122 drives the second magnetic elements 150 to rotate.

More particularly, in the first embodiment, the material of the blades 130 is, for example, soft rubber, and the first sides 132 of the blades 130 are connected to two opposite sides of the frame 110 in an offset manner by adhering, welding, locking, or other fixing manners. The blades 130 extend from a side of the frame 110 to the other side of the frame 110 in an inclined manner. Further, the first magnetic elements 140 and the second magnetic elements 150 are, for example, permanent magnets. The neighboring sides of the first magnetic elements 140 and the second magnetic elements 150 are, for example, N poles, and the distant sides of the first magnetic elements 140 and the second magnetic elements 150 are, for example, S poles, so as to generate magnetic repulsion effect.

Referring to FIG. 2A, when the shaft 122 of the motor 120 drives the second magnetic elements 150 to rotate to close to the first magnetic elements 140 located on the blades 130, the first magnetic elements 140 and the second magnetic elements 150 are repulsed. At this time, the blades 130 may generate elastic deformation, such that the second sides 134 of the blades 130 swing towards a direction far away from the shaft 122. Next, when the shaft 122 of the motor 120 drives the second magnetic elements 150 to rotate to be far away from the first magnetic elements 140 on the blades 130, the blades 130 elastically restore towards the initial position, such that the second sides 134 of the blades 130 swing towards the direction close to the shaft 122. To sum up, the shaft 122 of the motor 120 continuously drives the second magnetic elements 150 to rotate to make the second sides 134 of the blades 130 to repeatedly swing, so as to generate stable swinging airflow.

It should be noted that in the conventional art, it is necessary to reserve a blade rotating space and a cooling airflow flowing space for the fan or the blower, such that it is impossible to reduce the total thickness. In the swing type fan 100*a* of the present invention, the second sides 134 of the blades 130 repeatedly swing to generate the airflow, so as to reduce the moving space required by the blades 130, and it is not necessary to reserve the conventional cooling airflow flowing space. Therefore, the total thickness of the present invention is relatively thin. Further, the motor of the conventional fan or the blower must be disposed in the scope of the frame, so it is impossible to reduce the total thickness of the frame. The motor 120 of the swing type fan 100*a* of the present invention is disposed on a side of the frame 110 without affecting the thickness of the frame 110. Therefore, the total thickness of the present invention can be further reduced.

In addition, when the swing type fan 100*a* of the present invention is assembled to a portable electronic device (not shown), such as the UMPC or a tablet personal computer, the total thickness can be adjusted according the thickness of the portable electronic device to reach an optimized design. The length of the shaft 122 and the number of the blades 130 can be adjusted according to the appearance of the portable electronic device and the flow of required airflow. For example, the thickness of the swing type fan 100*a* of the present invention can be approximately the same as the thickness of the portable electronic device, and the total length can be approximately the same as the length of a side of the portable electronic device, so as to provide the cooling airflow with preferred flow field uniformity to the portable electronic device.

In addition, the rotation speed of the motor 120 of the swing type fan 100*a* of the present invention is relatively low, so the present invention is relatively power saving, and the noise generated when the motor 120 rotates and the cooling airflow flows is relatively small. In addition, the structure of the swing type fan 100*a* of the present invention is relatively simple, so the wear and tear of the mechanical parts can be reduced, thereby being relatively durable.

In addition, in order to improve the efficiency of providing the cooling airflow by the swing type fan 110*a* and to improve the stability of the blades 130 during swing, the swing type fan 100*a* can further include a plurality of third magnetic elements 160, as shown in FIG. 2A. The third magnetic elements 160 are connected to the shaft 122, and are disposed opposite to the second magnetic elements 150. The third magnetic elements 160 are, for example, permanent magnets, with a side facing the shaft 122 being, for example, N pole, and a side far away from the shaft 122 being, for example, S pole. When the shaft 122 of the motor 120 drives the second magnetic elements 150 and the third magnetic elements 160 to rotate to make the second magnetic elements 150 far away from the first magnetic elements 140 on the blades 130, the third magnetic elements 160 get close to the blades 130. At this time, the first magnetic elements 140 and the third magnetic elements 160 are mutually attracted, such that the blades 130 generate elastic deformation to make the second sides 134 of the blades 130 swing to the direction close to the shaft 122. Accordingly, the blades 130 can repeatedly swing via the magnetic attraction or magnetic repulsion generated between the first magnetic elements 140 and the second magnetic elements 150, and between the first magnetic elements 140 and the third magnetic elements 160.

However, the embodiment is not used to limit the present invention. For example, the swing type fan 100*a* can only include one blade 130. At this time, only one first magnetic element 140 and one second magnetic element 150 which are corresponding to each other can be respectively disposed on the blade 130 and the shaft 122, or a plurality of first magnetic elements 140 and a plurality of second magnetic elements 150 which are corresponding to each other can be respectively disposed on the blade 130 and the shaft 122. In addition, the first sides 132 of the blades 130 in the first embodiment are connected to the two opposite sides of the frame 110 in an offset manner, but in other embodiments, the first sides 132 of the blades 130 can also be connected to the same side of the frame 110. In other embodiments, the portable electronic device can also be low price mobile computer, palmtop, personal digital assistant (PDA), or mobile phone.

In addition, in other embodiments, the second magnetic elements 150 can pass through the shaft 122 of the motor 120, such that an end is made to form the second magnetic element 150 of the above embodiment, and the other end is made to form the third magnetic element 160 of the above embodiment. Alternatively, when the shaft 122 of the motor is replaced by the ferromagnetic material, and the material is at least one of iron, cobalt, and nickel, the shaft 122 can be directly magnetized to be a element with the function of a permanent magnet, so as to make a side form a N pole, and to make the other side form a S pole. At this time, the second magnetic elements 150 and the third magnetic elements 160 can be considered as being integrally formed with the shaft 122.

In addition, one of the first magnetic elements 140 and the second magnetic elements 150 (and/or the third magnetic elements 160) can be replaced by the ferromagnetic material, and the material, for example, includes at least one of iron, cobalt, and nickel. At this time, the blades 130 swing towards the direction of the shaft 122 only via the magnetic attraction between the first magnetic elements 140 and the second magnetic elements 150 (and/or the third magnetic elements 160). Next, a restoring element (not shown, for example, a torsion spring) applies a preset offset force to the blades 130, such that the blades 130 swing to the direction away from the shaft 122 to return to the initial position. In addition, the blade 130 can also have a part of ferromagnetic material, such that it can be considered as being integrally formed with the blade 130, so it is not necessary to fix the first magnetic element 140 by using adhesive.

The Second Embodiment

Figure 2B:
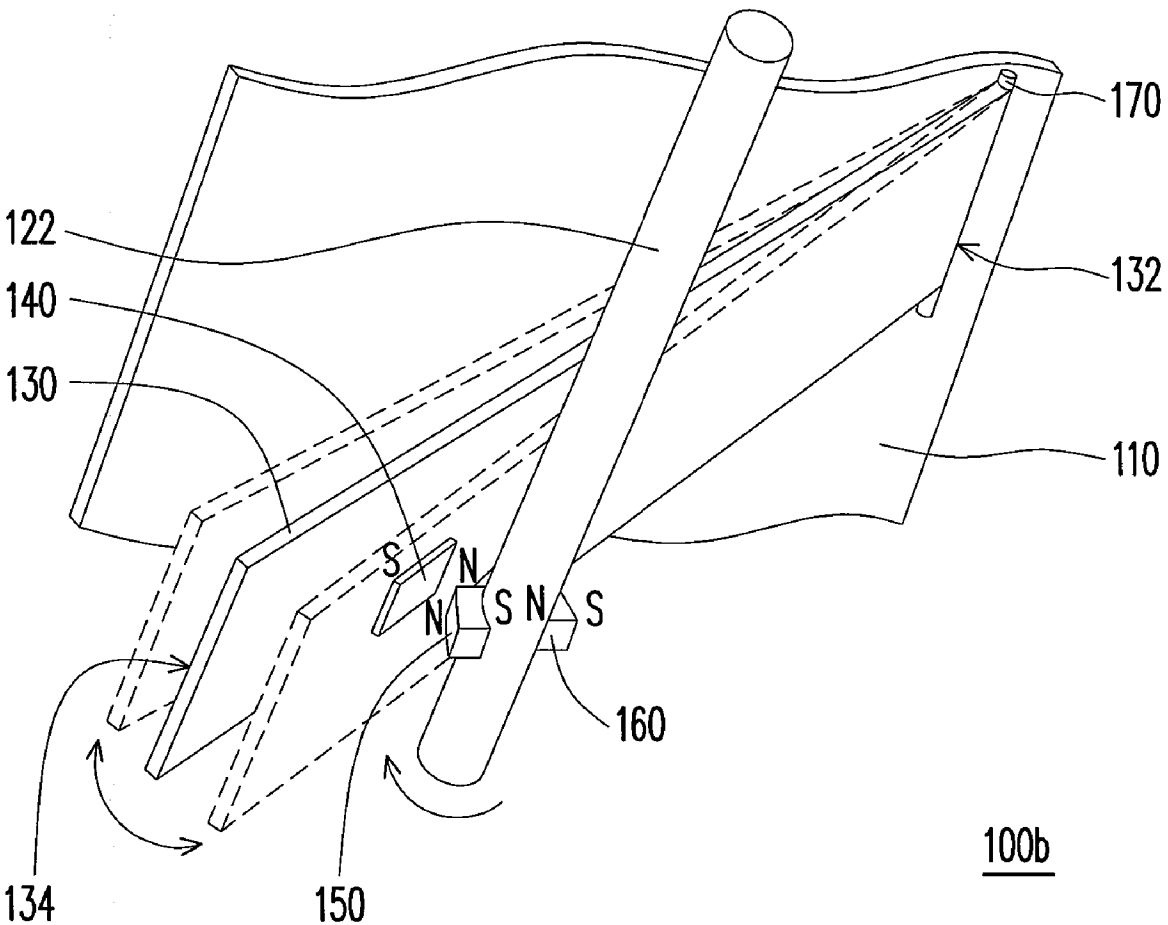
FIG. 2B is a schematic view of a partial enlarged structure and actuation of a swing type fan according to a second embodiment of the present invention.

FIG. 2B is a schematic view of a partial enlarged structure and actuation of a swing type fan according to the second embodiment of the present invention. Referring to FIG. 2B, a structure of a swing type fan 100*b* in the second embodiment is similar to the structure of the swing type fan 100*a* in the first embodiment. The difference between the two embodiments is that the first sides 132 of the blades 130 of the swing type 100*b* are pivoted to the frame 110 through a pivoting part 170. Therefore, the second sides 134 of the blades 130 swing along the pivoting parts 170 via the magnetic force between the first magnetic elements 140 and the second magnetic elements 150 as the shaft 122 drives the second magnetic elements 150 to rotate. The manner of generating the magnetic force of the first magnetic elements 140 and the second magnetic elements 150 is the same as that in the first embodiment, so it is not described repeatedly.

It should be noted that in the first embodiment, the blade 130 must swing by elastic deformation, so it is necessary to select soft material as the material thereof. However, in the second embodiment, it is not necessary for the blade 130 to generate elastic deformation, such that the material can select a rigid material or carbon fiber with light weight. In addition, the pivoting parts 170 of the frame 110 can use a limiting part (not shown) to limit the rotating angle of the blade 130, so as to limit the swing angle of the blade 130 in a preset swing scope.

As compared with the fan and the blower in the conventional art, in the swing type fan of the present invention, the blade has relatively small amplitude of swing and the motor has relatively low rotation speed. Therefore, the swing type fan not only has thin total thickness but also has relatively low power consumption amount, and the noise generated by the rotating of the motor and the flowing of the cooling airflow during operation is also relatively small. Further, the total length and thickness of the swing type can be optimally designed according to the appearance of the portable electronic device, and the rotation speed of the motor is adjusted to make it provide the cooling airflow with preferred flow field uniformity to the portable electronic device. In addition, the structure of the swing type fan is relatively simple, so as to reduce the wear and tear of the mechanical part, thereby being relatively durable.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A swing type fan, comprising:

a frame;

a motor, having a shaft and fixed to the frame, wherein the shaft passes through the frame;

a plurality of blades, disposed between the shaft and the frame, wherein each blade has a first side and a second side opposite to the first side, and the first sides are connected to opposite two sides of the frame in an offset manner;

a plurality of first magnetic elements, disposed on the blades, wherein each first magnetic element is respectively located between the first side and the second side of the corresponding blade; and a plurality of second magnetic elements, connected to the shaft, and corresponding to the first magnetic elements; and a plurality of third magnetic elements, connected to the shaft, and disposed opposite to the second magnetic elements, wherein the second magnetic elements and the first magnetic elements are mutually attracted, the third magnetic elements and the first magnetic elements are mutually repulsed, and the second sides of the blades swing via magnetic forces between the first magnetic elements and the second magnetic elements and between the first magnetic elements and the third magnetic elements as the shaft drives the second magnetic elements and the third magnetic elements to rotate.

2. The swing type fan as claimed in claim 1, wherein the first sides of the blades are fixed to the frame, and the blades swing by elastic deformation.

3. The swing type fan as claimed in claim 2, wherein the first sides of the blades are fixed to the frame by adhering, welding, or locking.

4. The swing type fan as claimed in claim 1, wherein the material of the blades comprises soft rubber.

5. The swing type fan as claimed in claim 1, wherein the first sides of the blades are pivoted to the frame, and the blades swing via the magnetic forces.

6. The swing type fan as claimed in claim 1, wherein the first magnetic elements, the second magnetic elements, and the third magnetic elements are permanent magnets.

* * * * *